United States Patent [19]

Waltrip

[11] 4,028,040

[45] June 7, 1977

[54] MATERIAL MIXING AND COMPACTING APPARATUS

[75] Inventor: Owen R. Waltrip, Roseville, Calif.

[73] Assignee: Nuclear Supreme, Casper, Wyo.

[22] Filed: July 9, 1976

[21] Appl. No.: 704,077

[52] U.S. Cl. ..... 425/449; 425/376 A; 425/378 R; 425/442; 425/447; 425/222

[51] Int. Cl.[2] ..... B29C 3/04

[58] Field of Search ..... 425/242 R, 243, 244, 425/317, 376 A, 376 R, 378, 442, 256, 257, 447, 449, DIG. 43, 222

[56] References Cited

UNITED STATES PATENTS

| | | | |
|---|---|---|---|
| 3,147,165 | 9/1964 | Slayter | 425/83 X |
| 3,164,863 | 1/1965 | Hunt | 425/376 A |
| 3,223,379 | 12/1965 | Erickson | 425/289 X |
| 3,225,715 | 12/1965 | Page | 425/376 R X |
| 3,230,902 | 1/1966 | Grimm et al. | 425/378 X |
| 3,425,092 | 2/1969 | Toga | 425/378 X |
| 3,467,743 | 9/1969 | Otani | 425/376 R X |

*Primary Examiner*—Robert L. Spicer, Jr.
*Attorney, Agent, or Firm*—Clarence A. O'Brien; Harvey B. Jacobson

[57] ABSTRACT

Molten coke forming material is processed by infeed through sealing gates to an elongated housing within which it is mixed, cooled and compacted into a solid mass. When sufficiently hardened, the compacted mass is expelled from the housing. A gas may be injected into that zone of the housing within which the material undergoes mixing while in a molten state.

11 Claims, 3 Drawing Figures

MATERIAL MIXING AND COMPACTING APPARATUS

BACKGROUND OF THE INVENTION

This invention relates to the formation of solid products such as coke or solid fuel logs from molten material.

Apparatus for processing particulate materials and slurries by mixing, agitating and compacting operations is well known. Generally such apparatus is unsuitable for processing materials under controlled conditions of temperature and pressure whereby desired chemical reactions as well as physical changes may occur by reason thereof. It is therefore an important object of the present invention to provide apparatus wherein mixing, agitating and compaction operations are performed in the presence of a controlled gaseous atmosphere under controlled pressure and temperature conditions particularly suited for the handling of an infeed in a molten state.

SUMMARY OF THE INVENTION

In accordance with the present invention a molten material from which coke or the like is to be formed, is fed through a pair of sealing conduits to the mixing zone of an elongated housing within which the material is controllably cooled by flow of coolant through a cooling jacket surrounding the housing. Pressurized conditions within the mixing zone are maintained by regulating infeed through the sealing conduits by means of alternately opened gates through which the molten material passes into the mixing zone of the housing. A spiral auger mixes the material within the mixing zone while it is in a molten state and displaces it into a compaction zone within which it hardens into a solid mass. A gas such as hydrogen may be injected into the molten material through axially spaced orifices formed in a tubular drive shaft on which the spiral auger blade is mounted.

The molten infeed may be derived from processing apparatus as disclosed in my copending application, U.S. Ser. No. 703,438, filed July 8, 1976. The compacted solid mass of material formed is expelled from the housing by forming the housing with pivoted sections along the compaction zone. The solid mass may then be cut into logs and packaged.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING FIGURES

DETAILED DESCRIPTION OF A PREFERRED EMBODIMENT

Figure 1:
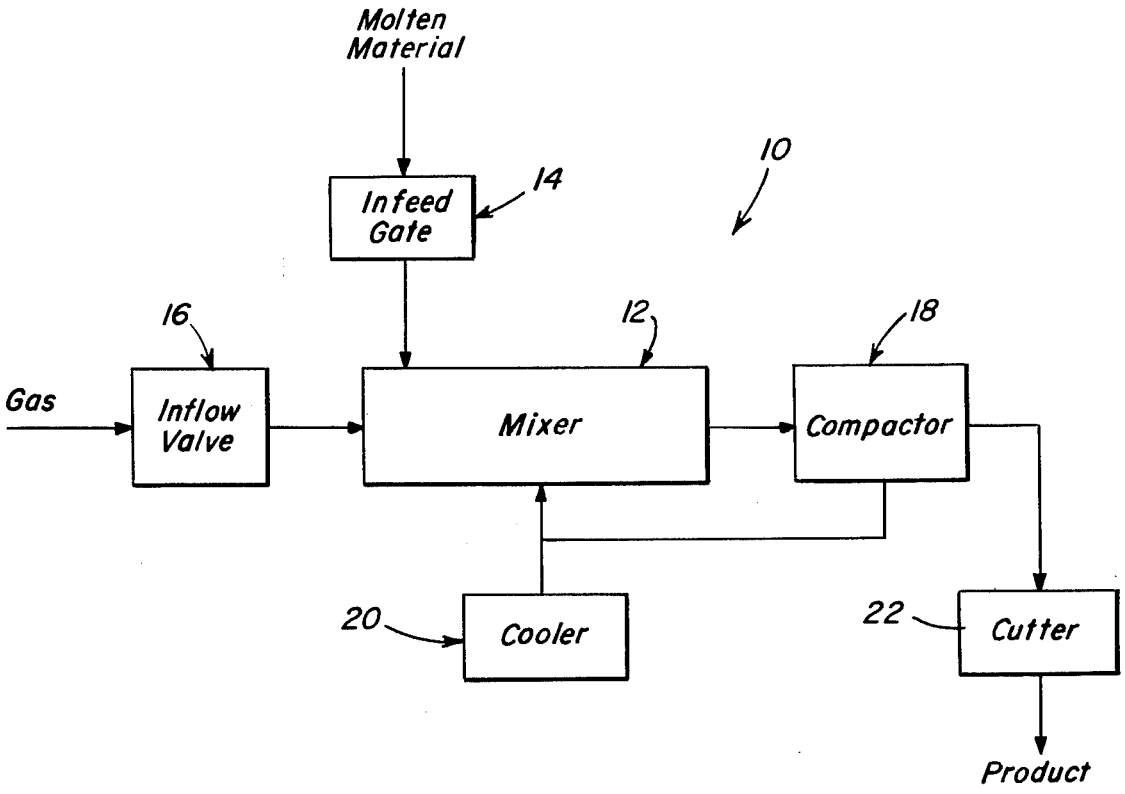
FIG. 1 is a schematic block diagram illustrating the sytem of the present invention.

Referring now to the drawings in detail, FIG. 1 illustrates the system of the present invention generally denoted by reference numeral 10. By means of the system illustrated, a molten material is processed and converted into a product such as logs of solid fuel or coke. As hereinbefore indicated, the molten material may be derived from processing apparatus such as disclosed in my copending application aforementioned. The molten material is delivered to a mixer 12 through an infeed gate component 14 arranged to maintain the interior of the mixer pressure sealed. Gas such as hydrogen is supplied from a suitable source through an inflow valve component 16 to the mixer for physical and chemical reaction with the molten material. The molten material is displaced into a compactor 18 within which a solid mass of material is formed. The chemical composition and physical properties of the product formed within the compactor 18 will not only be determined by the ingredients within the molten material delivered to the system, but will also be determined by the pressure and temperature conditions within the mixer and the gas supplied thereto. Temperature conditions are controlled by a cooler 20 which causes the molten material to harden into the solid mass formed in the compactor. When the solid mass is properly formed, it is displaced or expelled from the compactor and cut to a desired product size by a cutter 22. The foregoing system is particularly suited for the production of coke logs which may be packaged and marketed within cylindrical packaging material.

Figure 2:
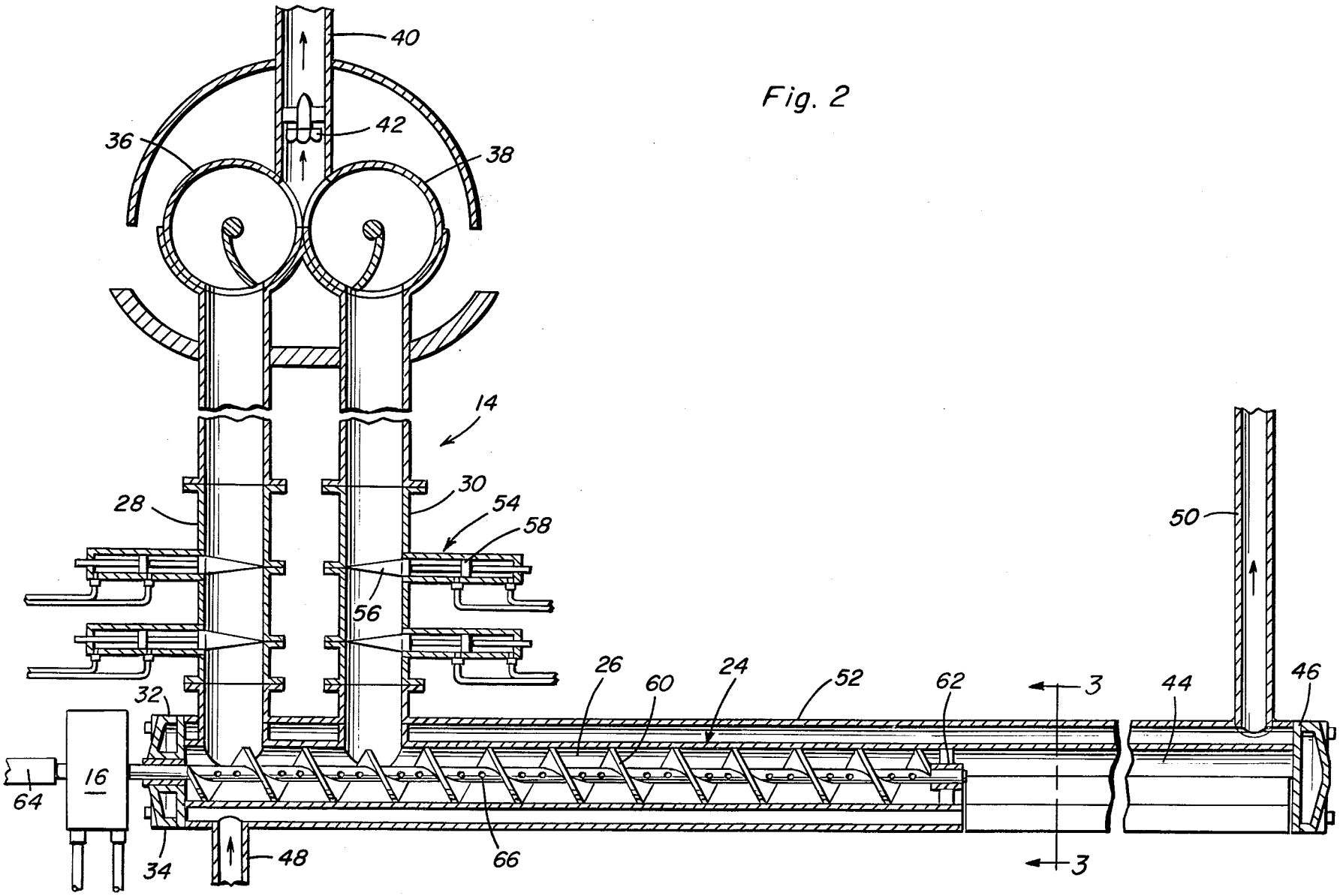
FIG. 2 is a side sectional view through apparatus associated with the system illustrated in FIG. 1.

Referring now to FIG. 2, apparatus for carrying out the system of the present invention is shown and includes an elongated housing 24 having a mixing zone 26 within which the mixing operation is formed as hereinbefore indicated with respect to mixer component 12 in FIG. 1. The molten material is supplied to the housing 24 adjacent one axial end by the infeed gate mechanism generally referred to by reference numeral 14 in FIG. 1 and FIG. 2. In the illustrated embodiment, the infeed gate mechanism includes a pair of pressure sealing infeed conduits 28 and 30 closely spaced from the end cover 32 of the housing into which a tubular drive shaft 34 extends. The molten material is fed to the conduits 28 and 30 by a pair of auger feed devices 36 and 38 connected to the upper ends of the conduits 28 and 30. The auger infeed devices 36 and 38 are adapted to maintain the conduits sealed most of the time and expel any volatiles entrapped within the molten material through an exhaust conduit 40 having an exhaust flow inducing blower 42 mounted therein. After the molten material is mixed and agitated within the mixing zone 26 it is displaced into a somewhat longer compaction zone 44 within the housing 24 adjacent the opposite end closed by cover 46. As the material is being mixed and compacted within the housing, it is also cooled as aforementioned in connection with FIG. 1 by a coolant circulated between inlet 48 and outlet 50 connected to a cooling jacket 52 surrounding the housing.

Each of the sealing conduits 28 and 30 includes at least two axially spaced gate devices 54. Each gate device includes a flow blocking element 56 adapted to be displaced by a fluid operated piston 58 between the flow blocking position shown and a retracted position permitting passage of the molten material downwardly through the conduit into the housing. The gate devices 54 are operated alternately or in sequence so that at least one of the gate elements will be maintaining the conduit sealed at any time. In this fashion, a regulated amount of molten material may be fed into the housing through the two conduits 28 and 30 while maintaining pressure conditions therein.

The molten material is mixed, agitated and axially displaced through the mixing zone 26 of the housing by means of a spiral auger blade 60 mounted on the tubular drive shaft 34 which extends through the mixing zone between a bearing mounted in the end cover 32 and a bearing 62 mounted between the mixing zone 26 and the compaction zone 44 of the housing. The inflow valve component 16 aforementioned with respect to FIG. 1, is mounted on the tubular drive shaft 34 externally of the housing as shown in FIG. 2 and is fluid operated so as to control the inflow of a gas such as hydrogen connected to the tubular drive shaft through a conduit 64. The gas is injected into the material within the compaction zone 26 through a plurality of axially spaced orifices 66 formed in the tubular drive shaft as shown.

Figure 3:
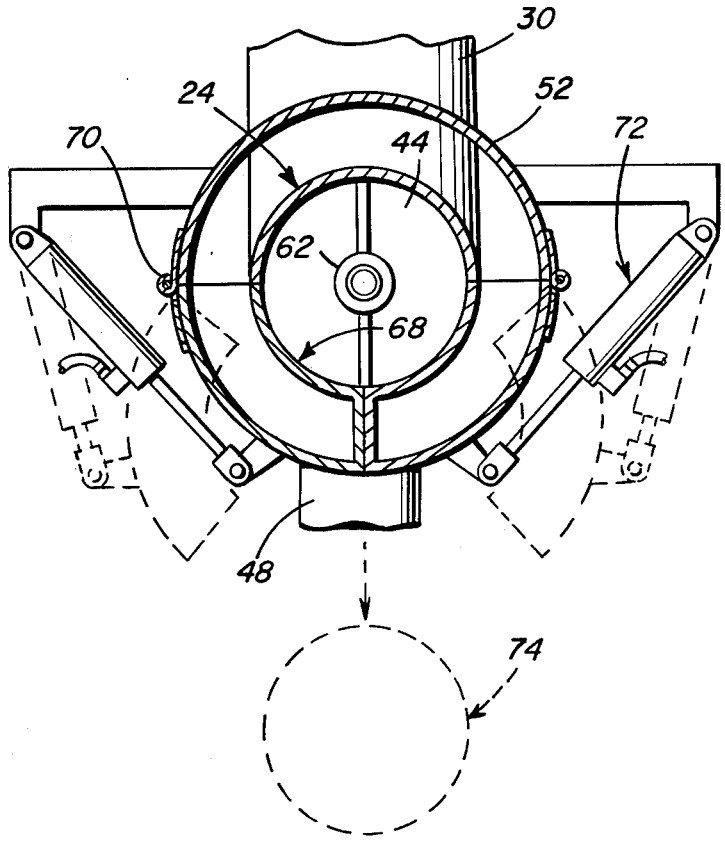
FIG. 3 is an enlarged transverse sectional view taken substantially through a plane indicated by section line 3—3 in FIG. 2.

As more clearly seen in FIG. 3, the housing 24 is provided with pivoted sections 68 mounted by means of hinges 70 along the compaction zone 44. These pivoted sections are adapted to be pivotally displaced to open positions as shown by dotted line in FIG. 3 by means of suitable operating mechanisms 72 when the solid mass of material is formed within the compaction zone. Accordingly, the solid mass of material 74 is shown by dotted line in FIG. 3 may be expelled from the compaction zone by opening of the pivoted sections 68. The solid mass of material 74 may then be cut into logs as aforementioned and packaged.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. Apparatus for processing a molten material, comprising an elongated housing having a pressure sealed mixing zone and a compaction zone, means for regulating infeed of said molten material into the mixing zone of the housing, means for displacing the material received from the infeed regulating means from the mixing zone into the compaction zone, means for injecting fluid into the material within the mixing zone, means for cooling the material within the housing to form a solid mass within the compaction zone, and means for expelling the solid mass, when formed, from the compaction zone.

2. The combination of claim 1 wherein said infeed regulating means includes an infeed sealing conduit and alternately operable gate means for sequentially permitting passage of the molten material delivered to the conduit toward the housing.

3. The combination of claim 2 wherein said displacing means includes a tubular drive shaft extending into the housing and terminating at said compaction zone and spiral blade means mounted on the drive shaft.

4. The combination of claim 3 wherein said fluid injecting means includes a source of pressurized gas and inflow valve means connecting said source to the drive shaft, said drive shaft having a plurality of axially spaced orifices through which the gas is injected into the housing.

5. The combination of claim 4 wherein said expelling means includes a pivoted section of the housing opened to expose the compaction zone.

6. The combination of claim 5 wherein said material is coke.

7. The combination of claim 1 wherein said displacing means includes a tubular drive shaft extending into the housing and terminating at said compaction zone and spiral blade means mounted on the drive shaft.

8. The combination of claim 7 wherein said fluid injecting means includes a source of pressurized gas and inflow valve means connecting said source to the drive shaft, said drive shaft having a plurality of axially spaced orifices through which the gas is injected into the housing.

9. The combination of claim 1 wherein said expelling means includes a pivoted section of the housing opened to expose the compaction zone.

10. The combination of claim 1 wherein said material is coke.

11. Apparatus for processing a molten material, comprising an elongated housing having a pressure sealed mixing zone and a compaction zone, means for regulating infeed of said molten material into the mixing zone of the housing, a tubular drive shaft extending into the housing and terminating at said compaction zone, a source of gas connected to the drive shaft, said drive shaft having a plurality of axially spaced orifices through which the gas is injected into the housing, and blade means mounted on the drive shaft for mixing the material and displacing the same into the compaction zone in response to rotation of the drive shaft, said housing including a pivoted section opened to expose the compaction zone.

* * * * *